US012797935B2

(12) United States Patent
Ishizuka et al.

(10) Patent No.: US 12,797,935 B2
(45) Date of Patent: Nov. 17, 2026

(54) MOLDING DEVICE

(71) Applicant: SUMITOMO HEAVY INDUSTRIES, LTD., Tokyo (JP)

(72) Inventors: Masayuki Ishizuka, Niihama (JP); Kozaburo Sakamaki, Niihama (JP); Hiroyuki Kumeno, Niihama (JP); Norieda Ueno, Niihama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 323 days.

(21) Appl. No.: 18/418,187

(22) Filed: Jan. 19, 2024

(65) Prior Publication Data

US 2024/0157427 A1 May 16, 2024

Related U.S. Application Data

(63) Continuation of application No. PCT/JP2022/033727, filed on Sep. 8, 2022.

(30) Foreign Application Priority Data

Sep. 8, 2021 (JP) ..... 2021-146105

(51) Int. Cl.
*B21D 26/033* (2011.01)

(52) U.S. Cl.
CPC ..... *B21D 26/033* (2013.01)

(58) Field of Classification Search
CPC ..... C21D 9/085; B21D 37/16; B21D 26/053; B21D 26/033; B21D 26/041
See application file for complete search history.

(56) References Cited

U.S. PATENT DOCUMENTS

| | | | | |
|---|---|---|---|---|
| 2017/0066028 | A1* | 3/2017 | Ishizuka | B21D 37/16 |
| 2018/0214924 | A1* | 8/2018 | Singh | C22C 38/02 |
| 2020/0318211 | A1 | 10/2020 | Hoesl | |

FOREIGN PATENT DOCUMENTS

| | | | |
|---|---|---|---|
| CA | 3 129 578 | A1 | 10/2020 |
| DE | 10 2011 102800 | A1 | 12/2011 |
| EP | 4 480 595 | A1 | 12/2024 |
| JP | H8-323430 | A | 12/1996 |
| JP | 2005-059062 | A | 3/2005 |
| JP | 2005-161402 | A | 6/2005 |
| JP | 2008-284592 | A | 11/2008 |
| JP | 2013-188793 | A | 9/2013 |
| JP | 2015-221445 | A | 12/2015 |
| JP | 2018167312 | A * | 11/2018 |
| JP | 2021 053688 | A | 4/2021 |

OTHER PUBLICATIONS

Translation of JP-2018167312-A.*
European search report of EP Application No. 22867404.0 Mailed on Feb. 12, 2025.

(Continued)

*Primary Examiner* — Bobby Yeonjin Kim
(74) *Attorney, Agent, or Firm* — WTA IP Law P.C.

(57) ABSTRACT

A molding device that heats a metal material and performs quenching and that molds a plurality of components having shapes different from each other in one time of molding with respect to one metal material.

10 Claims, 13 Drawing Sheets

(56) References Cited

OTHER PUBLICATIONS

Office Action of the corresponding JP Application No. 2023-546983 Mailed on Feb. 24, 2026.
International Search Report of PCT/JP2022/033727 Mailed on Nov. 22, 2022.
Office Action of the corresponding EP22867404.0 mailed on Apr. 10, 2026.
Examiner's Report of the corresponding CA Application No. 3,226,872 Mailed on Jun. 11, 2026.

* cited by examiner

MOLDING DEVICE

CROSS-REFERENCE TO RELATED APPLICATIONS

This is a bypass continuation of International PCT Application No. PCT/JP2022/033727, filed on Sep. 8, 2022, which claims priority to Japanese Patent Application No. 2021-146105, filed on Sep. 8, 2021, which are incorporated by reference herein in their entirety.

BACKGROUND

Technical Field

A certain embodiment of the present disclosure relates to a molding device.

Description of Related Art

In the related art, a device described in the related art is known as a molding device that molds a metal material. The molding device molds a plate-shaped member into a component having a desired shape by pressing the member.

SUMMARY

According to an aspect of the present disclosure, there is provided a molding device that heats a metal material and performs quenching and that molds a plurality of components having shapes different from each other in one time of molding with respect to one metal material.

According to another aspect of the present disclosure, there is provided a molding device that performs expansion molding by supplying a fluid to a metal material and that molds a plurality of components having shapes different from each other in one time of molding with respect to one metal material.

DETAILED DESCRIPTION

The component molded by the molding device described above is used in order to construct a predetermined structure. Therefore, it is required for the molding device to mold a plurality of components by performing a plurality of times of pressing. However, in a case where the number of components of the structure increases, a problem of an increase in man-hours arises since the number of times of pressing increases.

Therefore, it is desirable to provide a molding device that can reduce man-hours for manufacturing a plurality of components.

The molding device is the molding device that performs molding by heating the metal material and performing quenching. The molding device molds the plurality of components having shapes different from each other in one time of molding with respect to the one metal material. For this reason, the molding device can mold the plurality of components at once only by performing one time of molding with respect to the one metal material. For this reason, man-hours for manufacturing the plurality of components can be reduced.

The molding device is the molding device that performs expansion molding by supplying the fluid to the metal material. The molding device molds the plurality of components having shapes different from each other in one time of molding with respect to the one metal material. For this reason, the molding device can mold the plurality of components at once only by performing one time of molding with respect to the one metal material. For this reason, man-hours for manufacturing the plurality of components can be reduced.

The molding device may mold a component having a closed section as the component. In this case, the number of components can be reduced compared to a case of forming a structure in which a plurality of components are combined.

The molding device may mold a long first component and a second component and a third component, which are on both sides of the first component in a longitudinal direction, as the plurality of components. Accordingly, as the long first component is molded, the second component and the third component can be added to both sides thereof in the longitudinal direction and be molded.

The molding device may have differential strength between one component and another component of the plurality of components. Accordingly, strength is easily adjusted according to use of each component.

Hereinafter, a preferred embodiment of a molding device according to the present disclosure will be described with reference to the drawings. In each drawing, the same reference signs will be assigned to the same portions or equivalent portions, and redundant description thereof will be omitted.

Figure 1:
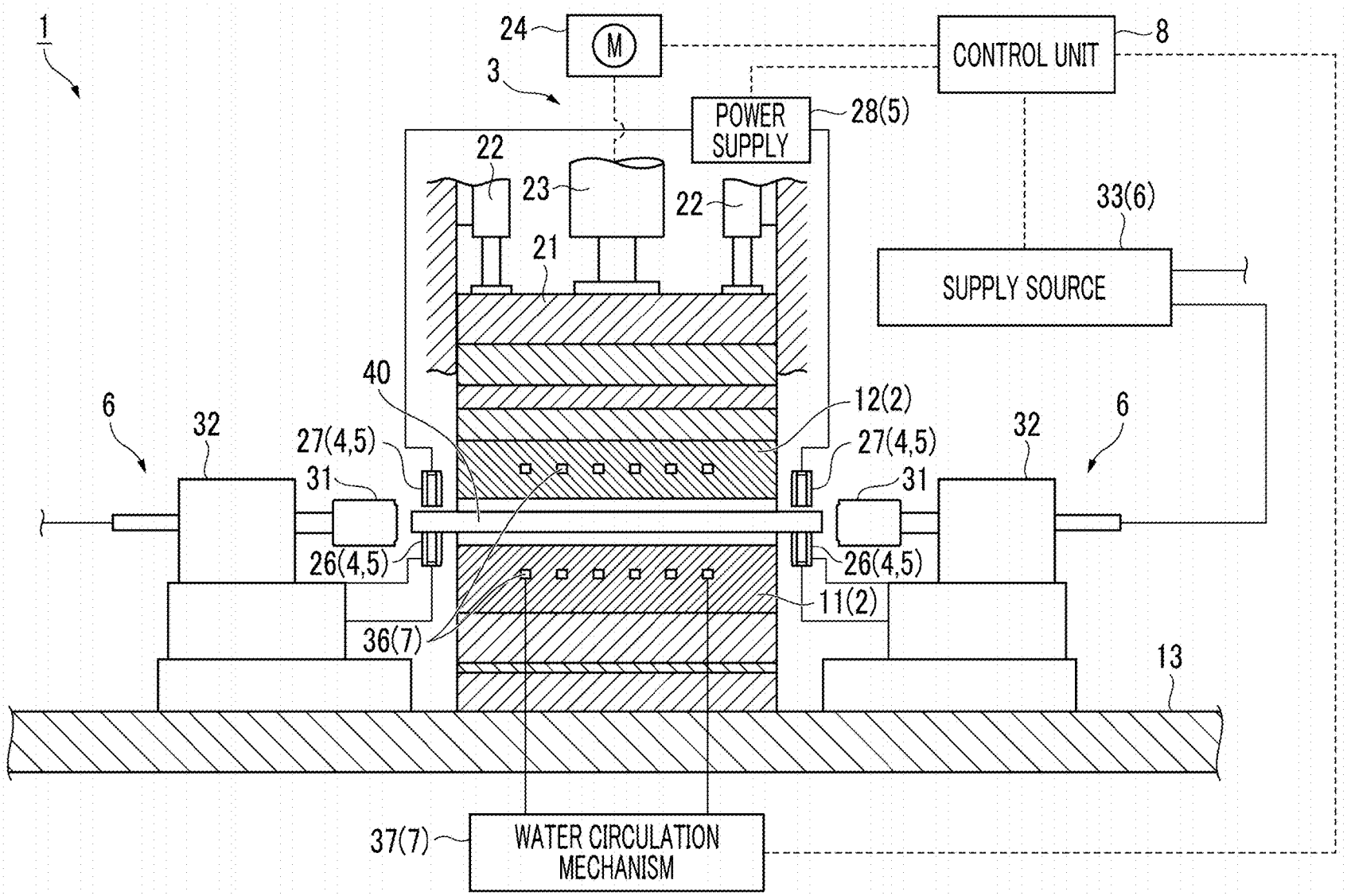
FIG. 1 is a schematic configuration view showing a molding device according to an embodiment of the present disclosure.

FIG. 1 is a schematic configuration view of a molding device 1 according to the present embodiment. As shown in FIG. 1, the molding device 1 is a device that molds a metal pipe having a hollow shape by blow forming. In the present embodiment, the molding device 1 is provided on a horizontal plane. The molding device 1 includes a molding die 2, a drive mechanism 3, a holding unit 4, a heating unit 5, a fluid supply unit 6, a cooling unit 7, and a control unit 8. In the present specification, a metal pipe material 40 (metal material) refers to a hollow article before the completion of molding by the molding device 1. The metal pipe material 40 is a steel-type pipe material that can be quenched. In addition, in a horizontal direction, a direction in which the metal pipe material 40 extends during molding is called a "longitudinal direction", and a direction perpendicular to the longitudinal direction is called a "width direction" in some cases.

The molding die 2 is a die that molds the metal pipe material 40 into a metal pipe 140 and includes a lower die 11 and an upper die 12 that face each other in an up-down direction. The lower die 11 and the upper die 12 are configured by blocks made of steel. Each of the lower die 11 and the upper die 12 is provided with a recessed part in which the metal pipe material 40 is accommodated. In a state where the lower die 11 and the upper die 12 are in close contact with each other (die closed state), respective recessed parts form a space having a target shape, into which the metal pipe material is to be molded. Therefore, surfaces of the respective recessed parts become forming surfaces of the molding die 2. The lower die 11 is fixed to a base stage 13 via a die holder or the like. The upper die 12 is fixed to a slide of the drive mechanism 3 via a die holder or the like.

The drive mechanism 3 is a mechanism that moves at least one of the lower die 11 and the upper die 12. In FIG. 1, the drive mechanism 3 has a configuration of moving only the upper die 12. The drive mechanism 3 includes a slide 21 that moves the upper die 12 such that the lower die 11 and the upper die 12 are joined together, a pull-back cylinder 22 that is an actuator which generates a force for pulling the slide 21 upward, a main cylinder 23 that is a drive source which downward-pressurizes the slide 21, and a drive source 24 that applies a driving force to the main cylinder 23.

The holding unit 4 is a mechanism that holds the metal pipe material 40 disposed between the lower die 11 and the upper die 12. The holding unit 4 includes a lower electrode 26 and an upper electrode 27 that hold the metal pipe material 40 on one end side in the longitudinal direction of the molding die 2 and a lower electrode 26 and an upper electrode 27 that hold the metal pipe material 40 on the other end side in the longitudinal direction of the molding die 2. The lower electrodes 26 and the upper electrodes 27 on both sides in the longitudinal direction hold the metal pipe material 40 with vicinities of end portions of the metal pipe material 40 sandwiched therebetween from the up-down direction. Groove portions having a shape corresponding to an outer peripheral surface of the metal pipe material 40 are formed in upper surfaces of the lower electrodes 26 and lower surfaces of the upper electrodes 27. Drive mechanisms (not shown) are provided in the lower electrode 26 and the upper electrode 27 and are movable independently of each other in the up-down direction.

The heating unit 5 heats the metal pipe material 40. The heating unit 5 is a mechanism that heats the metal pipe material 40 by energizing the metal pipe material 40. The heating unit 5 heats the metal pipe material 40 in a state where the metal pipe material 40 is separated apart from the lower die 11 and the upper die 12 between the lower die 11 and the upper die 12. The heating unit 5 includes the lower electrodes 26 and the upper electrodes 27 on both sides in the longitudinal direction described above and a power supply 28 that causes a current to flow to the metal pipe material 40 via the electrodes 26 and 27. The heating unit may be disposed in a preceding process of the molding device 1 and may perform heating externally.

The fluid supply unit 6 is a mechanism for supplying a high-pressure fluid into the metal pipe material 40 held between the lower die 11 and the upper die 12. The fluid supply unit 6 supplies the high-pressure fluid into the metal pipe material 40 that has been brought into a high-temperature state by being heated by the heating unit 5 and expands the metal pipe material 40. The fluid supply units 6 are provided on both end sides of the molding die 2 in the longitudinal direction. The fluid supply units 6 each include a nozzle 31 that supplies a fluid from opening portions of the end portions of the metal pipe material 40 to an inside of the metal pipe material 40, a drive mechanism 32 that moves the nozzle 31 to advance and retreat with respect to the opening portions of the metal pipe material 40, and a supply source 33 that supplies the high-pressure fluid into the metal pipe material 40 via the nozzle 31. The drive mechanism 32 brings the nozzle 31 into close contact with the end portion of the metal pipe material 40 in a state where a sealing property is secured during fluid supply and exhaust and separates the nozzle 31 from the end portion of the metal pipe material 40 at other times. The fluid supply unit 6 may supply a gas such as high-pressure air and an inert gas as the fluid. In addition, the fluid supply unit 6 may be the same device including the holding unit 4 that includes a mechanism which moves the metal pipe material 40 in the up-down direction and the heating unit 5.

Figure 2A:
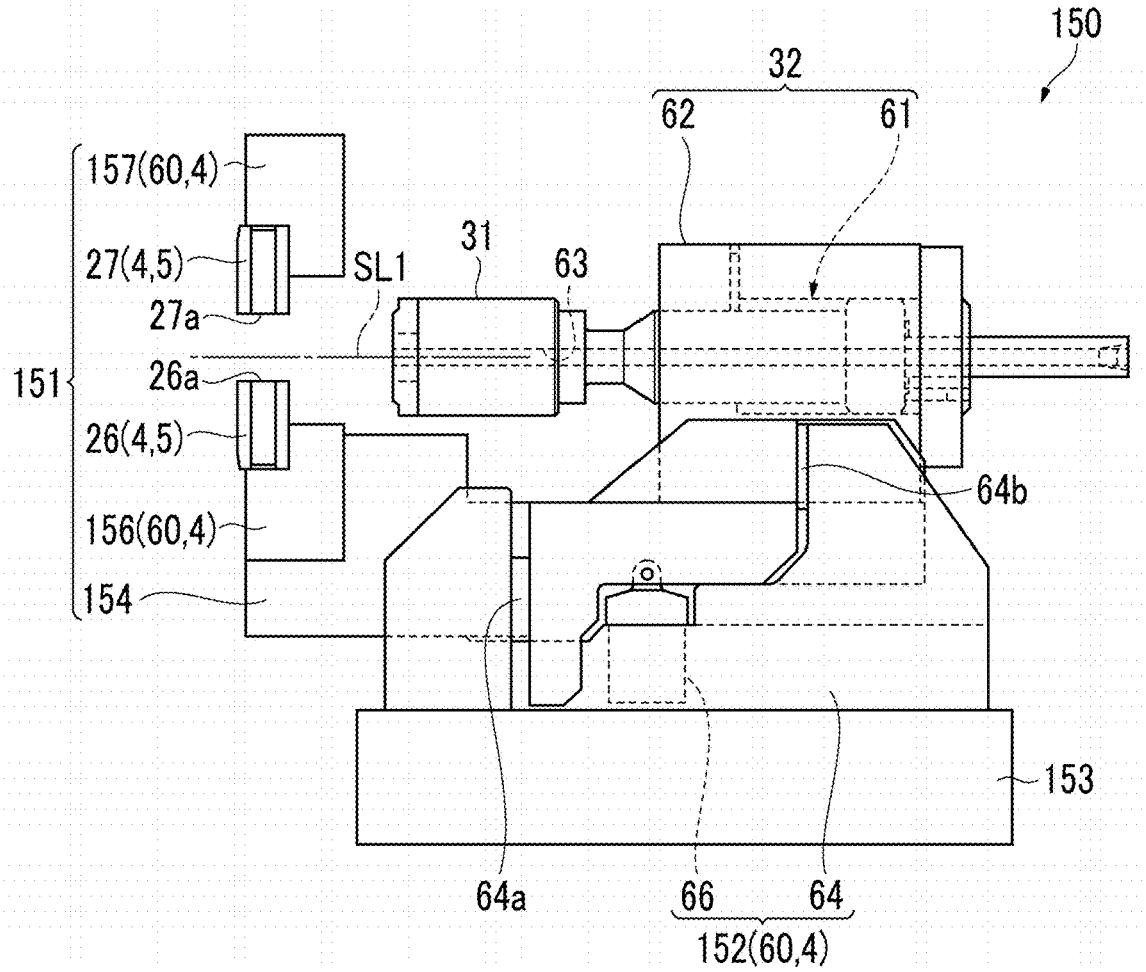
FIG. 2A is a schematic side view showing a heating and expanding unit.
Figure 2B:
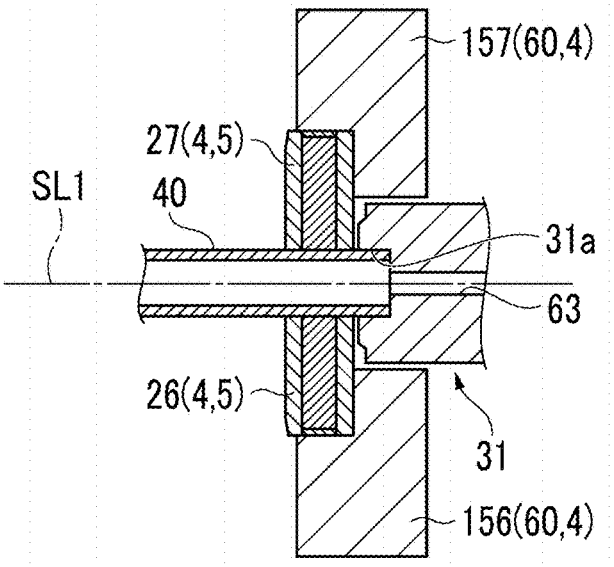
FIG. 2B is a sectional view showing a state where a nozzle has sealed a metal pipe material.

Components of the holding unit 4, the heating unit 5, and the fluid supply unit 6 may be configured as a unitized heating and expanding unit 150. FIG. 2A is a schematic side view showing the heating and expanding unit 150. FIG. 2B is a sectional view showing a state where the nozzle 31 has sealed the metal pipe material 40.

As shown in FIG. 2A, the heating and expanding unit 150 includes the lower electrodes 26 and upper electrodes 27, which are described above, an electrode mounting unit 151 on which each of the electrodes 26 and 27 is mounted, the nozzle 31 and the drive mechanism 32, which are described above, a lifting and lowering unit 152, and a unit base 153. The electrode mounting unit 151 includes a lifting and lowering frame 154 and electrode frames 156 and 157. The electrode frames 156 and 157 function as a part of a drive mechanism 60 that supports and moves each of the electrodes 26 and 27. The drive mechanism 32 drives the nozzle 31 and lifts and lowers together with the electrode mounting unit 151. The drive mechanism 32 includes a piston 61 that holds the nozzle 31 and a cylinder 62 that drives the piston. The lifting and lowering unit 152 includes a lifting and lowering frame base 64 that is attached to an upper surface of the unit base 153 and a lifting and lowering actuator 66 that applies a lifting and lowering operation to the lifting and lowering frame 154 of the electrode mounting unit 151 by the lifting and lowering frame base 64. The lifting and lowering frame base 64 includes guide portions 64*a* and 64*b* that guide the lifting and lowering operation of the lifting and lowering frame 154 with respect to the unit base 153. The lifting and lowering unit 152 functions as a part of the drive mechanism 60 of the holding unit 4. The heating and expanding unit 150 includes a plurality of unit bases 153 of which upper surfaces have different inclination angles and is allowed to collectively change and adjust inclination angles of the lower electrode 26, the upper electrode 27, the nozzle 31, the electrode mounting unit 151, the drive mechanism 32, and the lifting and lowering unit 152 by replacing the unit bases 153.

The nozzle 31 is a cylindrical member into which the end portion of the metal pipe material 40 can be inserted. The nozzle 31 is supported by the drive mechanism 32 such that a center line of the nozzle 31 matches a reference line SL1. An inner diameter of a feed port 31*a* at an end portion of the nozzle 31 on a metal pipe material 40 side substantially matches an outer diameter of the metal pipe material 40 after expansion molding. In this state, the nozzle 31 supplies a high-pressure fluid from an internal flow path 63 to the metal pipe material 40. Examples of the high-pressure fluid include a gas.

Returning to FIG. 1, the cooling unit 7 is a mechanism that cools the molding die 2. By cooling the molding die 2, the cooling unit 7 can rapidly cool the metal pipe material 40 when the expanded metal pipe material 40 has come into contact with the forming surface of the molding die 2. The cooling unit 7 includes a flow path 36 formed inside the lower die 11 and the upper die 12 and a water circulation mechanism 37 that supplies cooling water to the flow path 36 and that circulates the cooling water.

The control unit 8 is a device that controls the entire molding device 1. The control unit 8 controls the drive mechanism 3, the holding unit 4, the heating unit 5, the fluid supply unit 6, and the cooling unit 7. The control unit 8 repeatedly performs an operation of molding the metal pipe material 40 with the molding die 2.

Specifically, the control unit 8 controls, for example, a transport timing from a transport device such as a robot arm to dispose the metal pipe material 40 between the lower die 11 and the upper die 12 in an open state. Alternatively, a worker may manually dispose the metal pipe material 40 between the lower die 11 and the upper die 12. In addition, the control unit 8 controls an actuator or the like of the holding unit 4 such that the metal pipe material 40 is supported by the lower electrodes 26 on both sides in the longitudinal direction and then the upper electrodes 27 are lowered to sandwich the metal pipe material 40. In addition, the control unit 8 controls the heating unit 5 to energize and heat the metal pipe material 40. Accordingly, a current in an axial direction flows through the metal pipe material 40, and an electric resistance of the metal pipe material 40 itself causes the metal pipe material 40 itself to generate heat due to Joule heat.

The control unit 8 controls the drive mechanism 3 to lower the upper die 12 and to bring the upper die 12 close to the lower die 11, closing the molding die 2. Meanwhile, the control unit 8 controls the fluid supply unit 6 to seal the opening portions of both ends of the metal pipe material 40 and to supply a fluid with the nozzle 31. Accordingly, the metal pipe material 40 softened by heating expands and comes into contact with the forming surface of the molding die 2. Then, the metal pipe material 40 is molded to follow the shape of the forming surface of the molding die 2. In a case of forming a metal pipe with a flange, after a part of the metal pipe material 40 has entered a gap between the lower die 11 and the upper die 12, die closing is further performed to crush the entered portion to become a flange portion. When the metal pipe material 40 comes into contact with the forming surface, quenching of the metal pipe material 40 is performed by being rapidly cooled with the molding die 2 cooled by the cooling unit 7.

Figure 3A:
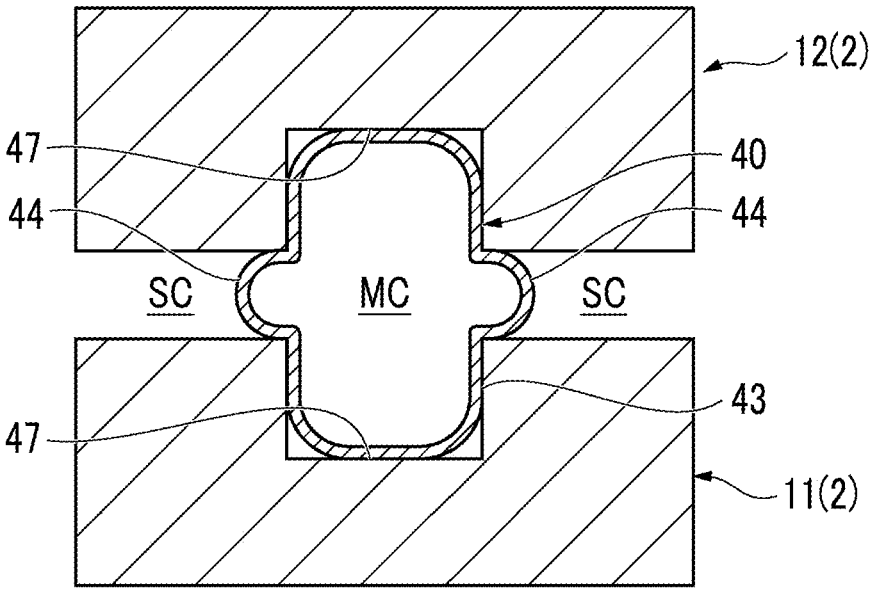
FIGS. 3A and 3B are sectional views showing states of molding.
Figure 3B:
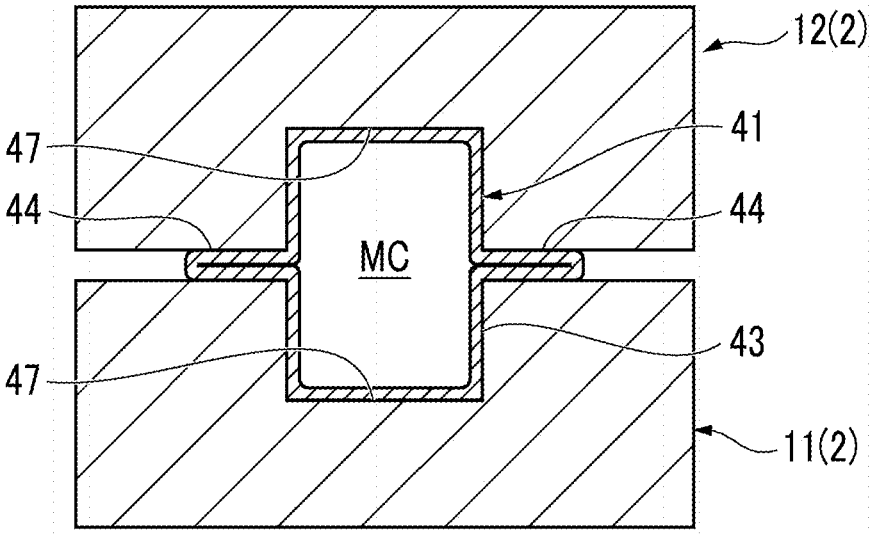

Procedures of molding of the molding device 1 will be described with reference to FIGS. 3A and 3B. As shown in FIG. 3A, the control unit 8 performs blow forming by closing the molding die 2 and supplying a fluid to the metal pipe material 40 with the fluid supply unit 6 (primary blow). In the primary blow, the control unit 8 molds a pipe portion 43 in a main cavity portion MC configured by a groove portion 47 of each of the dies 11 and 12 and causes a portion corresponding to a flange portion 44 to enter a sub-cavity portion SC. Then, as shown in FIG. 3B, the control unit 8 molds the flange portion 44 by further closing the molding die 2 and further crushing the portion that has entered the sub-cavity portion SC. Next, the control unit 8 performs die opening by lifting the upper die 12 to separate the upper die 12 from the metal pipe material 40. Accordingly, a molding product 41 is molded.

Next, what type of molding product 41 can be molded by the molding device 1 according to the present embodiment will be described. The molding device 1 is the molding device 1 that heats the metal pipe material 40 (metal material) and that performs quenching and can mold a plurality of components in one time of molding with respect to one metal pipe material 40. In addition, the molding device 1 is the molding device 1 that performs expansion molding by supplying a fluid to the metal pipe material 40 (metal material) and can mold a plurality of components in one time of molding with respect to one metal pipe material 40. One time of molding is a series of processes from the setting of a new metal pipe material 40 at the molding device 1 to molding of the molding product 41. In the molding device 1 according to the present embodiment, a series of processes including disposition, heating, and expansion molding of the metal pipe material 40 described above in the die 12 correspond to one time of molding. One metal material is a material made of a metal in a state of continuously extending without being cut in the middle.

Figure 4A:
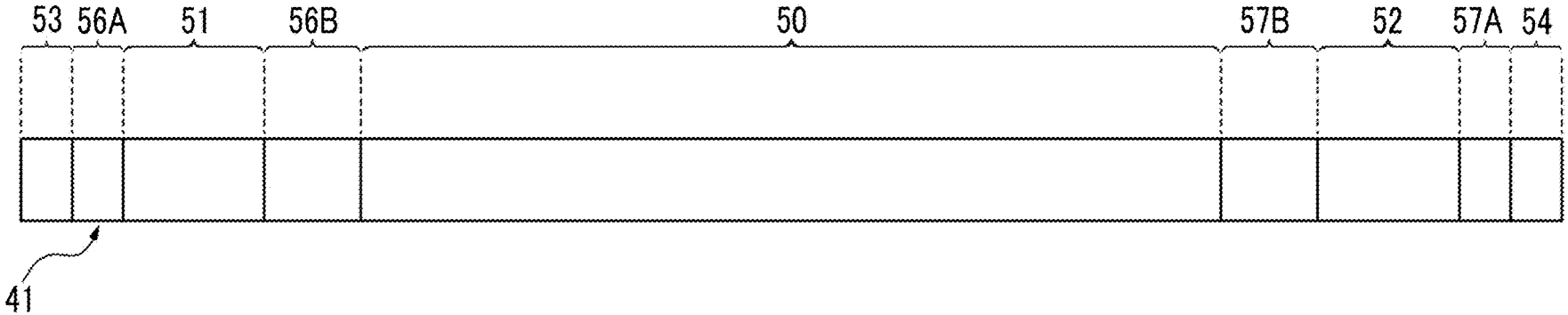
FIG. 4A is a schematic configuration view of a molding product.

The molding product 41 will be described with reference to FIG. 4A. Molding a plurality of components in one time of molding with respect to one metal pipe material 40 means that a plurality of components are included in the molding product 41. Before cutting of the molding product 41, the plurality of components are in a state of being connected to each other as one and the same member. In the example shown in FIG. 4A, the molding device 1 molds a long first component 50 and a second component 51 and a third component 52 on both sides of the first component 50 in the longitudinal direction. The second component 51 is provided on one end side of the molding product 41 in the longitudinal direction. An electrode portion 53 held by an electrode of the heating unit 5 is formed at a position farthest to the one end side of the molding product 41. A gradual change portion 56A is formed between the electrode portion 53 and the second component 51. A gradual change portion 56B is formed between the second component 51 and the first component 50. The third component 52 is provided on the other end side of the molding product 41 in the longitudinal direction. An electrode portion 54 held by an electrode of the heating unit 5 is formed at a position farthest to the other end side of the molding product 41. A gradual change portion 57A is formed between the electrode portion 54 and the third component 52. A gradual change portion 57B is formed between the third component 52 and the first component 50. The gradual change portions 56A, 56B, 57A, and 57B are portions of which a shape gradually changes by being formed between respective parts having a unique shape.

A boundary portion of each portion of the molding product 41 is cut through laser processing or the like. Accordingly, the first component 50, the second component 51, and the third component 52 can be treated as one independent component.

Since the entire molding product 41 is a tubular member, the components 50, 51, and 52 have a closed section. That is, the molding device 1 molds the components 50, 51, and 52 having a closed section as components.

Figure 4B:
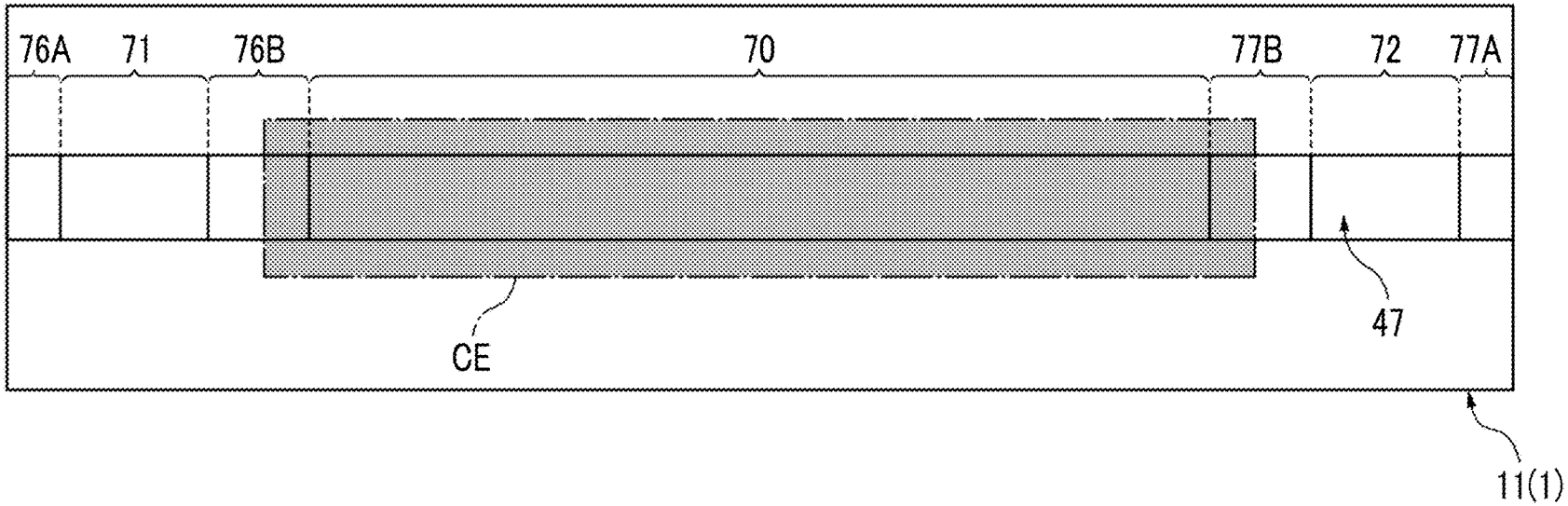
FIG. 4B is a schematic top view of a lower die.

FIG. 4B is a schematic top view showing the lower die 11 for molding the molding product 41 described above. The upper die 12 also has a configuration for the same effect. As shown in FIG. 4B, the groove portion 47 of the die 11 includes a gradual change molding portion 76A, a second component molding portion 71, a gradual change molding portion 76B, a first component molding portion 70, a gradual change molding portion 77B, a third component molding portion 72, and a gradual change molding portion 77A with positions and shapes corresponding to the gradual change portion 56A, the second component 51, the gradual change portion 56B, the first component 50, the gradual change portion 57B, the third component 52, and the gradual change portion 57A of the molding product 41.

The molding device 1 may have differential strength between one component and another component of a plurality of components. For example, the molding device 1 may have differential strength by making the strength of the first component 50 higher than those of the second component 51 and the third component 52. As a method of providing differential strength, the molding device 1 may perform molding such that quenching is performed with respect to a component having high strength and quenching is not performed with respect to a component having low strength. For example, the cooling unit 7 (see FIG. 1) of the molding device 1 may keep the temperature of a forming surface in a cooling region CE including the first component molding portion 70 at a temperature at which quenching can be performed with respect to the molding product 41 and keep temperatures of forming surfaces in other regions at a temperature at which quenching cannot be performed with respect to the molding product 41. For example, the cooling unit 7 may flow a sufficient amount of cooling water in the cooling region CE and may not flow cooling water in other regions (alternatively, a die temperature is raised by separately embedding a heater or the like to the extent that quenching does not occur, and a cooling speed at which quenching does not occur is secured). In this case, while forming surfaces of the second component molding portion 71 and the third component molding portion 72 do not perform quenching with respect to the second component 51 and the third component 52, a forming surface of the first component molding portion 70 performs quenching with respect to the first component 50.

Figure 5:
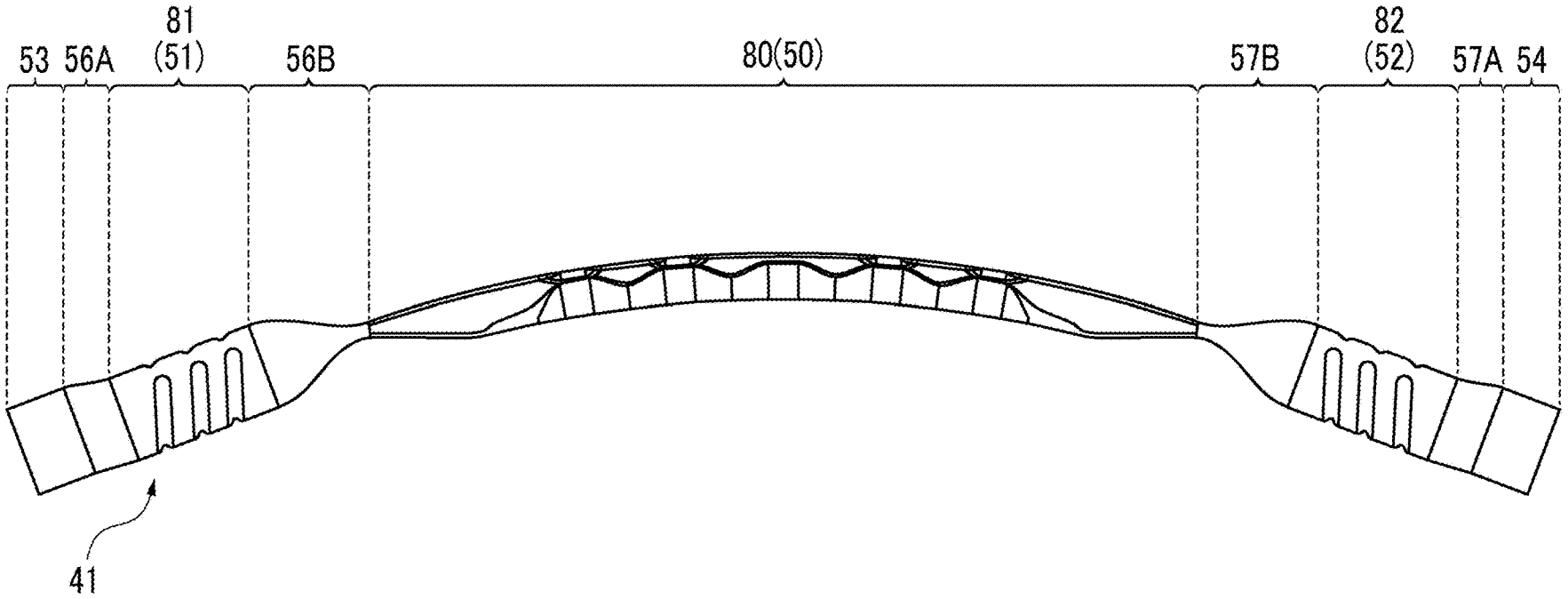
FIG. 5 is a view showing a specific example of the molding product.
Figure 6:
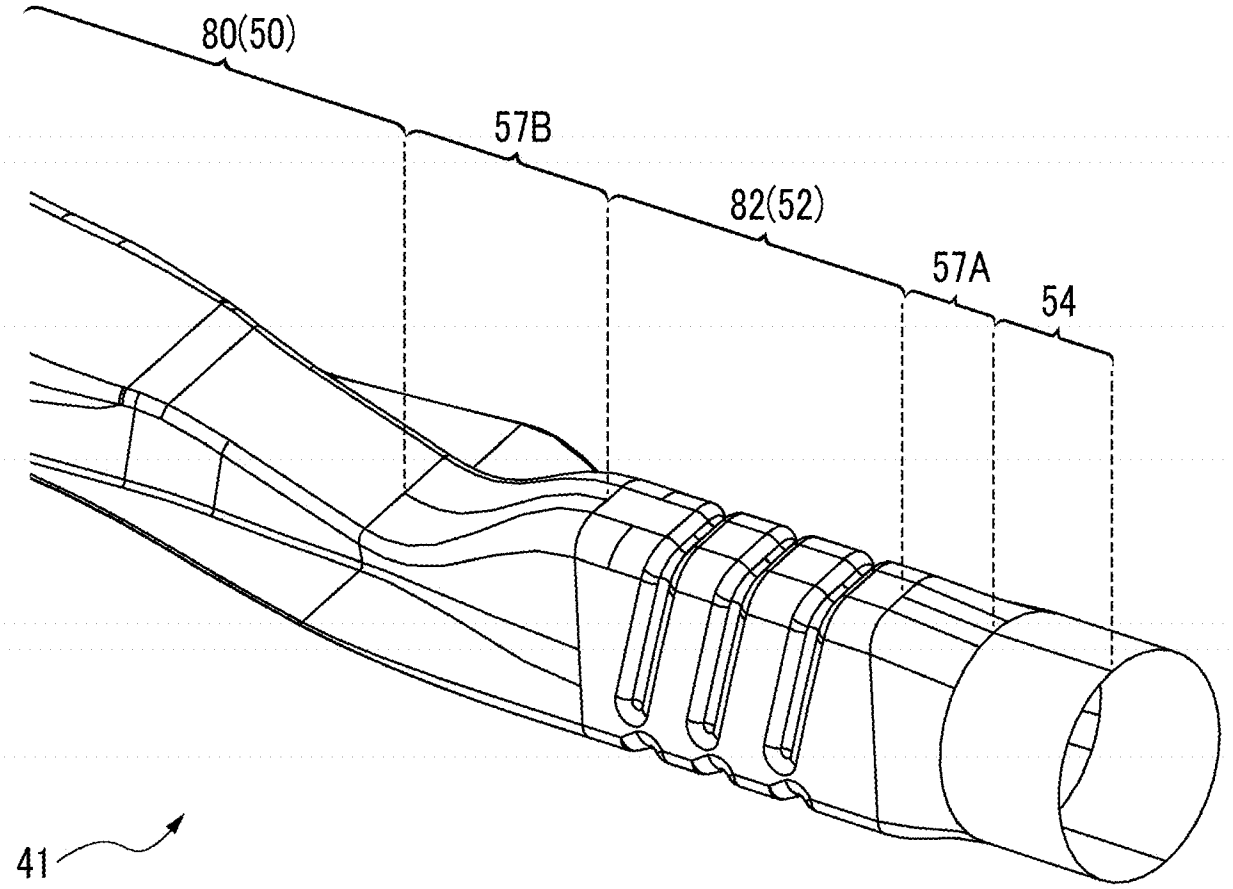
FIG. 6 is an enlarged perspective view of the molding product.

Next, further specific examples of components molded by the molding device 1 will be described with reference to FIGS. 5 to 8. FIG. 5 is a view showing a specific example of the molding product 41. FIG. 6 is an enlarged perspective view of the other end portion of the molding product 41. As shown in FIG. 5, the molding device 1 molds a bumper beam 80 as the first component 50. In addition, the molding device 1 molds a crush tube 81 as the second component 51 and molds a crush tube 82 as the third component 52. Since the long bumper beam 80 has a gently curved shape, the molding product 41 has a shape gently curved shape as a whole. Therefore, the electrode portions 53 and 54 are inclined downward toward an outer side in the longitudinal direction. Therefore, the heating and expanding unit 150 inclines the nozzle 31 and the electrodes 26 and 27 in accordance with such electrode portions 53 and 54 (see FIGS. 2A and 2B).

Figure 7:
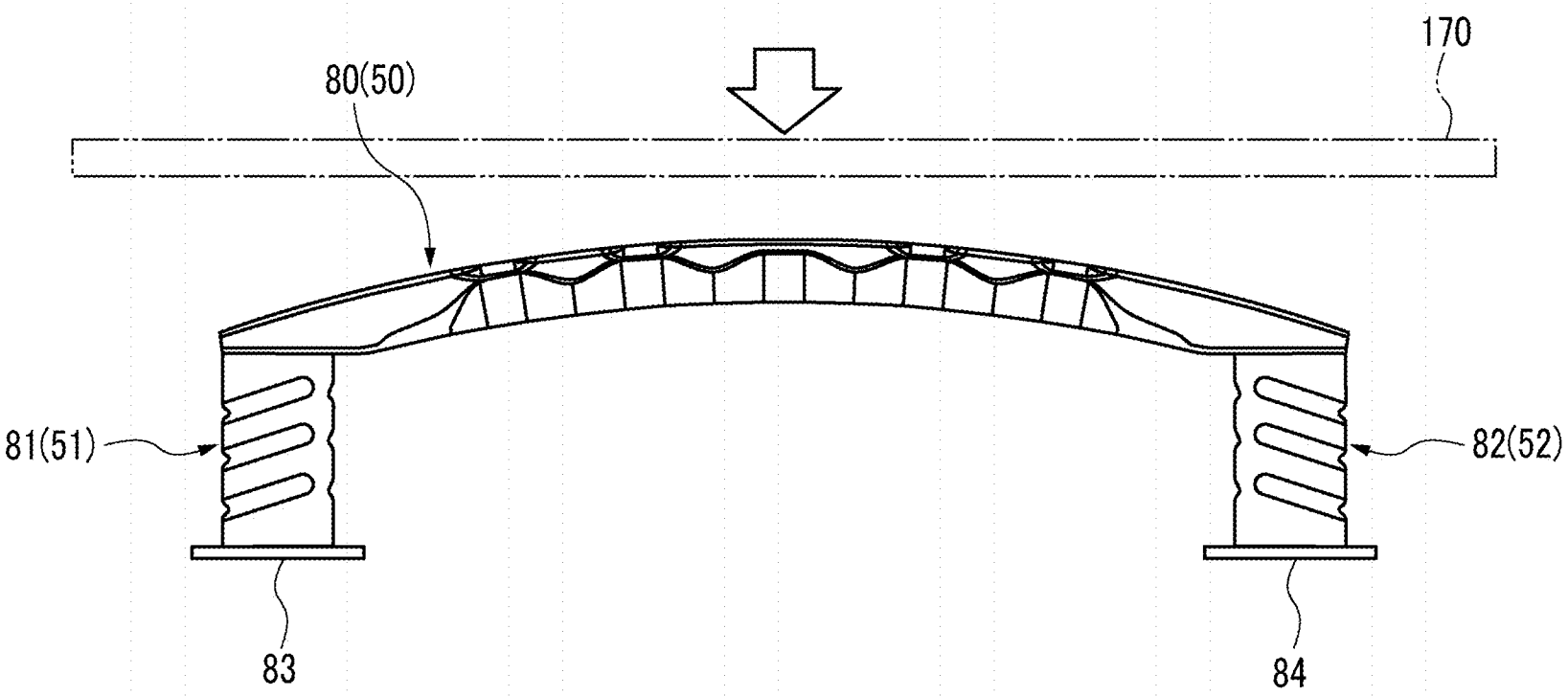
FIG. 7 is a view showing a front bumper.

The bumper beam 80 and the crush tube 82 are components configuring a front bumper 100 of a vehicle shown in FIG. 7. The front bumper 100 includes, at a front end portion of the vehicle, the bumper beam 80 that extends in a vehicle width direction in a state of being curved to be convex forward. In a case where the vehicle has collided from the front, the bumper beam 80 is a member that receives a load from the front. The front bumper 100 includes the crush tubes 81 and 82 provided at the rear of both end portions of the bumper beam 80 in the vehicle width direction. The crush tubes 81 and 82 are members that absorb the load by being crushed and that transmit the load to a skeletal structure on the rear side of the vehicle when the bumper beam has received the load. In addition, the front bumper 100 includes base plates 83 and 84 provided to spread in the up-down direction at rear ends of the crush tubes 81 and 82, respectively.

Figure 8:
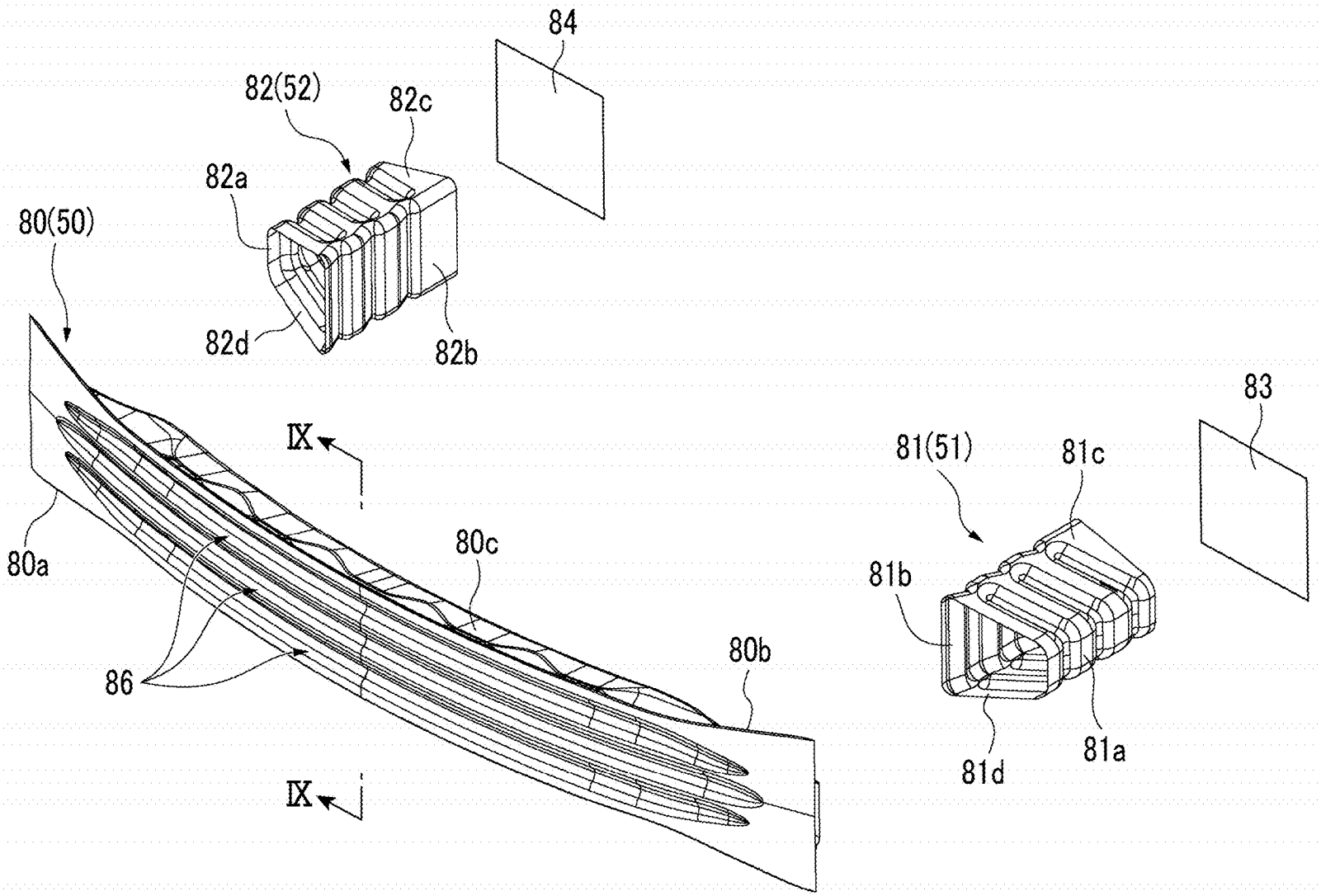
FIG. 8 is a developed perspective view showing the front bumper.
Figure 9:
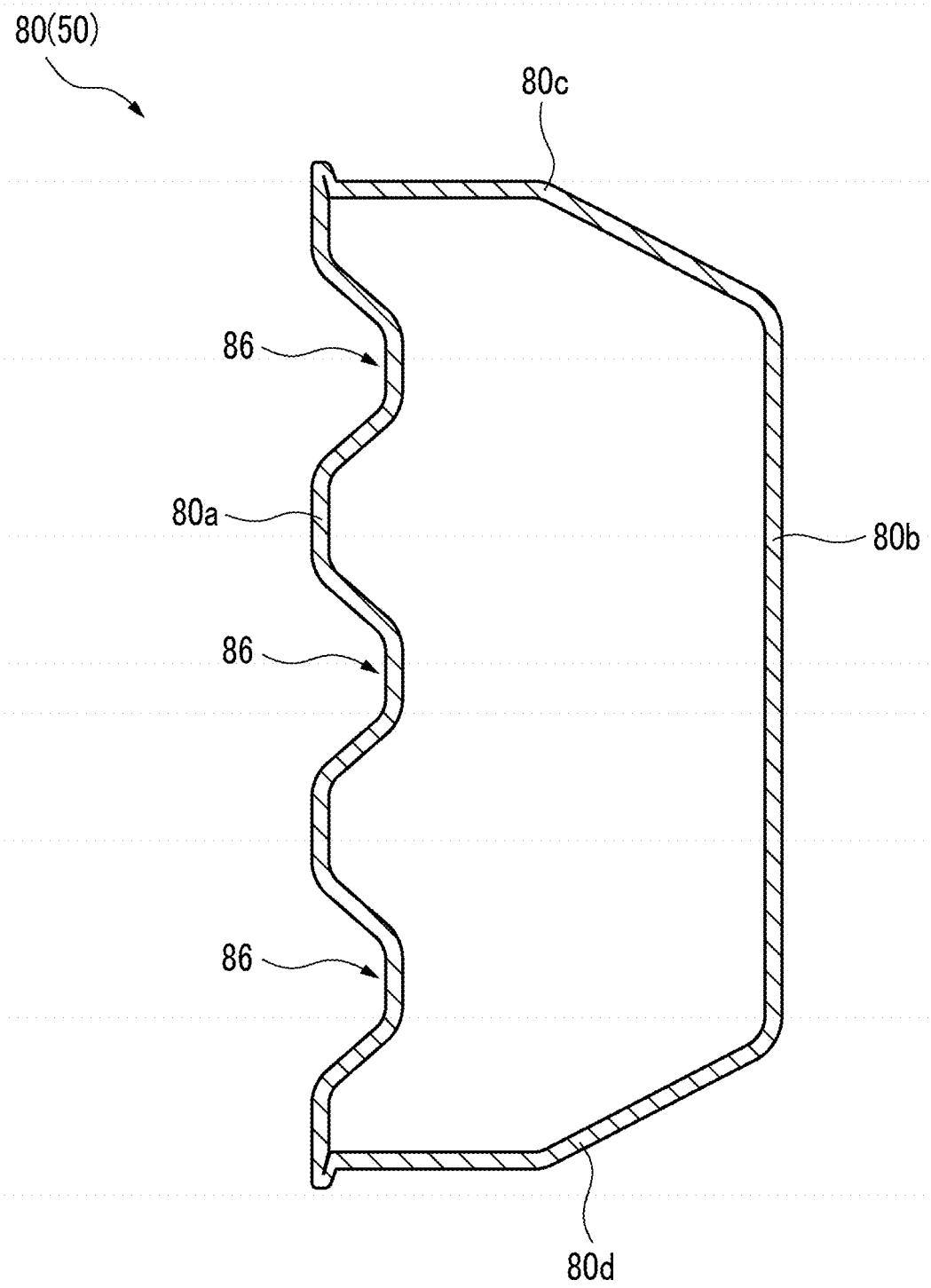
FIG. 9 is a sectional view taken along line IX-IX shown in FIG. 8.

As shown in FIG. 9, the bumper beam 80 includes a front wall portion 80*a*, a rear wall portion 80*b*, an upper wall portion 80*c*, and a lower wall portion 80*d*. Since the bumper beam 80 is molded by the molding device 1 described above, materials for portions connecting the front wall portion 80*a*, the rear wall portion 80*b*, the upper wall portion 80*c*, and the lower wall portion 80*d* to each other are continuous without being cut. That is, the bumper beam 80 is configured as one component having a closed section structure in which the front wall portion 80*a*, the rear wall portion 80*b*, the upper wall portion 80*c*, and the lower wall portion 80*d* are integrated. In the front wall portion 80*a*, a plurality of (herein, three) beads 86 are provided at different positions in the up-down direction. The beads 86 extend in a longitudinal direction of the bumper beam 80, that is, the vehicle width direction (see FIG. 8).

As shown in FIG. 8, the crush tubes 81 and 82 are tubular members extending in a front-rear direction. The crush tubes 81 and 82 are disposed in a posture in which the crush tubes 81 and 82 are open at a front end and a rear end. The crush tubes 81 and 82 include side wall portions 81*a* and 82*a* on an outer side in the vehicle width direction, side wall portions 81*b* and 82*b* on an inner side in the vehicle width direction, upper wall portions 81*c* and 82*c*, and lower wall portions 81*d* and 82*d*. Since the crush tubes 81 and 82 are molded by the molding device 1 described above, materials for portions connecting the side wall portions 81*a* and 82*a*, the side wall portions 81*b* and 82*b*, the upper wall portions 81*c* and 82*c*, and the lower wall portions 81*d* and 82*d* to each other are continuous without being cut. That is, the crush tubes 81 and 82 each are configured as one component having a closed section structure in which the side wall portions 81*a* and 82*a*, the side wall portions 81*b* and 82*b*, the upper wall portions 81*c* and 82*c*, and the lower wall portions 81*d* and 82*d* are integrated. The bumper beam 80 is set to have high material strength as quenching is performed. On the contrary, the crush tubes 81 and 82 are provided to have differential strength such that material strength is lower than that of the bumper beam 80 as quenching is not performed. Therefore, the crush tubes 81 and 82 can absorb a load by being crushed well.

As shown in FIG. 6, in a state of the molding product 41, a place corresponding to an end portion of the bumper beam 80 in the vehicle width direction and a place corresponding to an end portion of the crush tube 82 in the front-rear direction are disposed to face each other in the longitudinal direction, and both are connected to each other by the gradual change portion 57B. The gradual change portion 57B gradually changes from the shape of the end portion of the bumper beam 80 to the shape of the end portion of the crush tube 82. In addition, the place corresponding to the end portion of the crush tube 82 in the front-rear direction and the end portion of the electrode portion 54 are disposed to face each other in the longitudinal direction, and both are connected to each other by the gradual change portion 57A. The gradual change portion 57A gradually changes from the shape of the end portion of the crush tube 82 to an annular shape of the end portion of the electrode portion 54. An end portion of the molding product 41 on an opposite side (crush tube 81) also has a configuration for the same effect.

Next, operations and effects of the molding device 1 according to the present embodiment will be described.

The molding device 1 according to the present embodiment is the molding device 1 that heats the metal pipe material 40 (metal material) and that performs quenching and molds a plurality of components in one time of molding with respect to one metal pipe material 40.

The molding device 1 is the molding device 1 that performs molding by heating the metal pipe material 40 and performing quenching. The molding device 1 molds a plurality of components in one time of molding with respect to one metal pipe material 40. For this reason, the molding device 1 can mold the plurality of components at once only by performing one time of molding with respect to the one metal pipe material 40. For this reason, man-hours for manufacturing the plurality of components can be reduced.

The molding device 1 according to the present embodiment is the molding device 1 that performs expansion molding by supplying a fluid to the metal pipe material 40 (metal material) and molds a plurality of components in one time of molding with respect to one metal pipe material 40.

The molding device 1 is the molding device 1 that performs expansion molding by supplying a fluid to the metal pipe material 40. The molding device 1 molds a plurality of components in one time of molding with respect to one metal pipe material 40. For this reason, the molding device 1 can mold the plurality of components at once only by performing one time of molding with respect to the one metal pipe material 40. For this reason, man-hours for manufacturing the plurality of components can be reduced.

The molding device 1 may mold a component having a closed section as a component. In this case, the number of components can be reduced compared to a case of forming a structure in which a plurality of components are combined.

The molding device 1 may mold the long first component 50 and the second component 51 and the third component 52, which are on both sides of the first component 50 in the longitudinal direction, as a plurality of components. Accordingly, as the long first component 50 is molded, the second component 51 and the third component 52 can be added to both sides thereof in the longitudinal direction and be molded.

The molding device 1 may have differential strength between one component and another component of a plurality of components. Accordingly, strength is easily adjusted according to use of each component.

Figure 10:
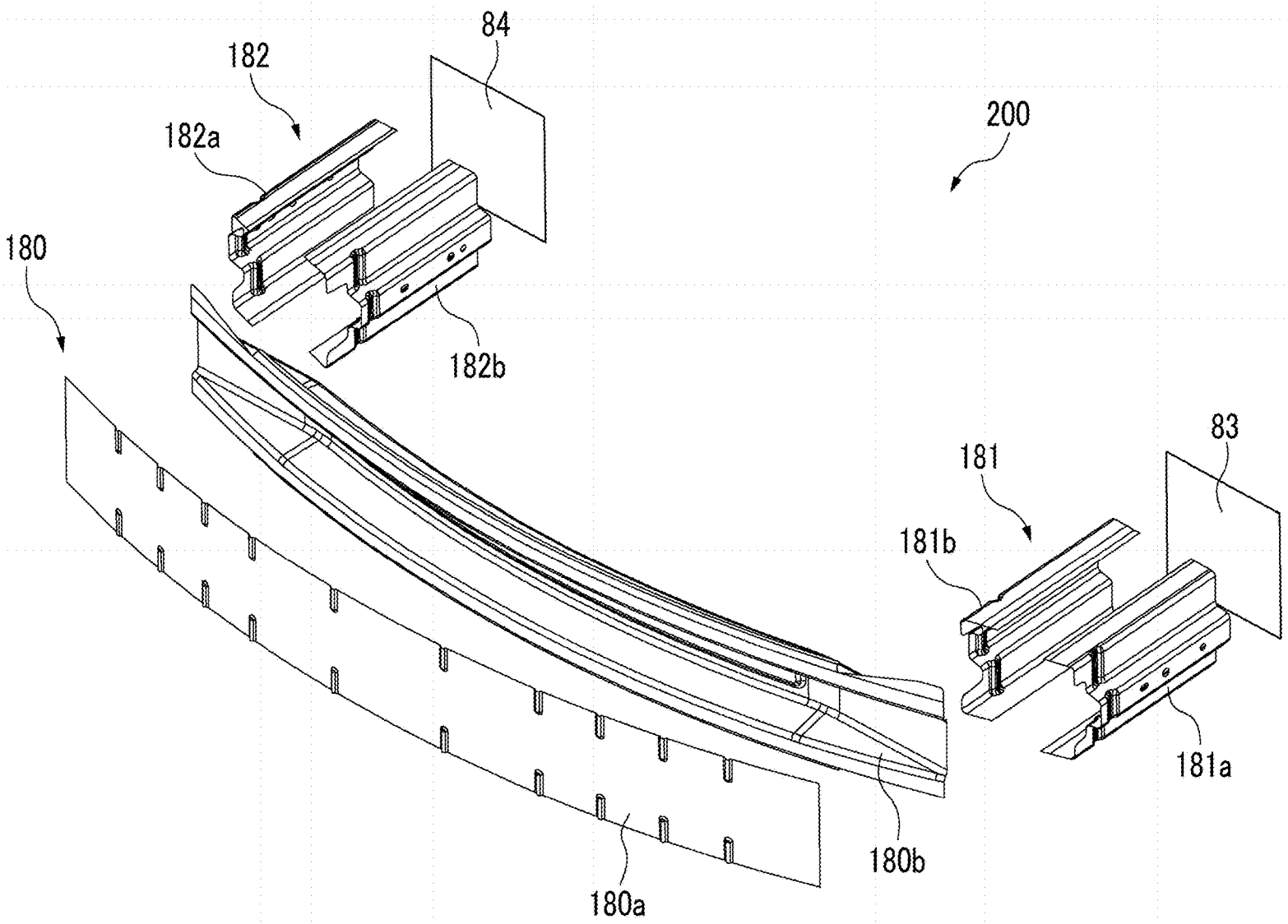
FIG. 10 is a developed perspective view showing a front bumper configured using a component molded by a molding device according to a comparative example.

An effect in a case of creating the front bumper 100 using the molding device 1 of the present embodiment will be described. Such a front bumper 100 is simply called an "example" in some cases. A case of creating a front bumper 200 shown in FIG. 10 will be described as a comparative example. As shown in FIG. 10, in the front bumper 200 according to the comparative example, a bumper beam 180 is configured by two components 180*a* and 180*b*, a crush tube 181 is configured by two members 181*a* and 181*b*, and a crush tube 182 is configured by two members 182*a* and 182*b*. A plate-shaped metal material is molded into each of the components through pressing, roll forming, or the like. However, since the plate thickness and material strength of each component are different, manufacturing equipment such as a die is required according thereto, and it takes man-hours and costs. In addition, although respective components are assembled to be completed as the front bumper 200 through welding, bolt fastening, or the like, since the number of components is eight including the base plates 83 and 84, man-hours and labor are required.

On the contrary, the molding device 1 of the present embodiment manufactures configuring components of the front bumper 100 according to the example in a steel tube air forming (STAF) process. Each of the bumper beam 80 and the crush tubes 81 and 82 is configured by one component. For this reason, the front bumper 100 can be kept to five components instead of eight components in the comparative example, and the number of components can be significantly reduced. In addition, in the front bumper 200 according to the comparative example, it is required to perform spot welding at dozens of places by bonding the components 180*a* and 180*b* that have been trimmed and drilled after being molded through pressing or roll forming. On the contrary, in the front bumper 100 according to the example, the process is completed only by trimming and drilling after molding the bumper beam 80. Accordingly, performance man-hours can be significantly reduced. The same applies to the crush tubes 81 and 82.

Further, as shown in FIG. 5, in the front bumper 100 according to the example, the bumper beam 80 and the crush tubes 81 and 82 are set as one molding product 41, and the components can be manufactured in one time of molding. For this reason, the molding device 1 can significantly reduce man-hours and labor compared to the comparative example.

Figure 11:
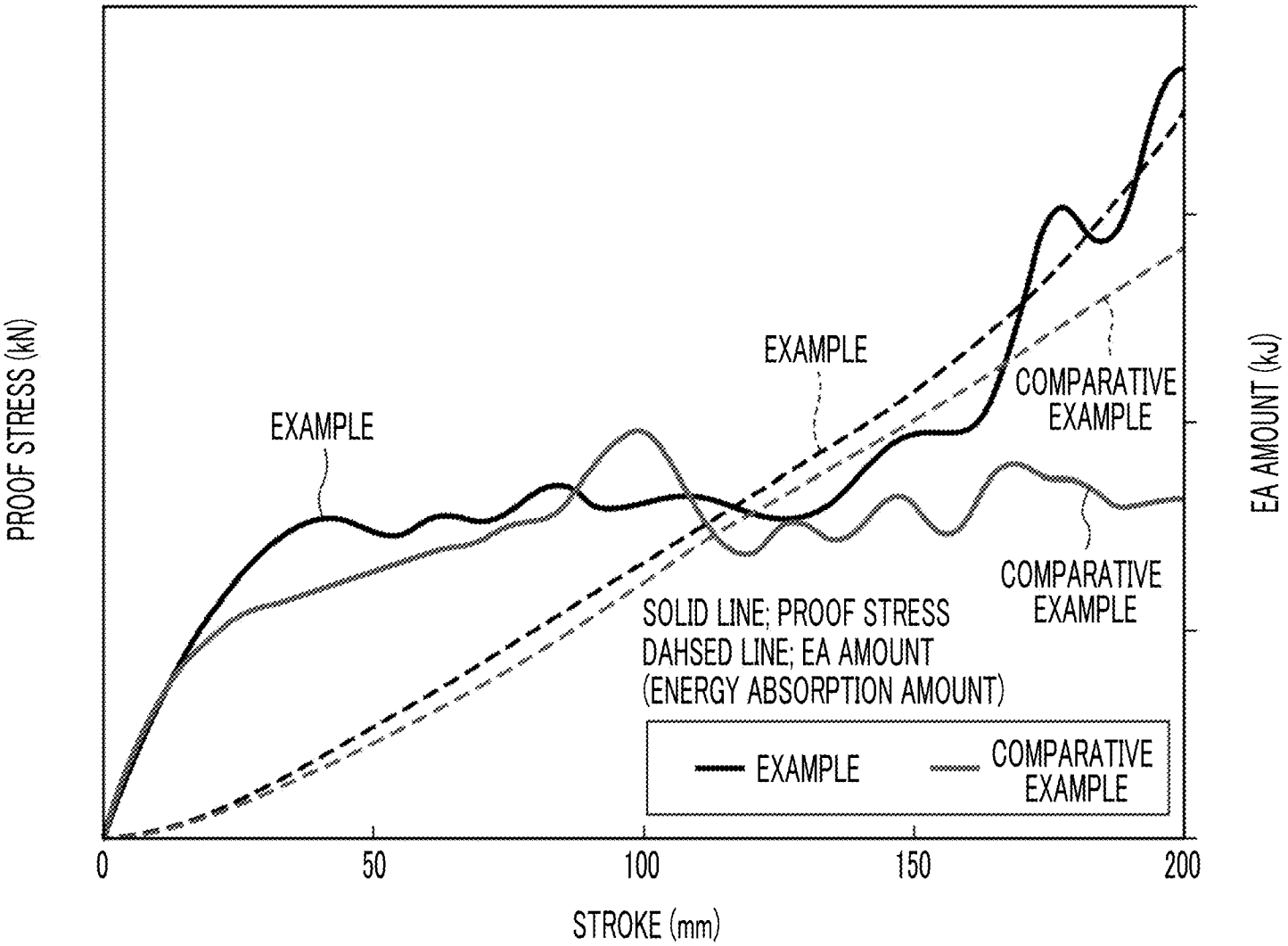
FIG. 11 is a view showing characteristics of the front bumper configured using a component molded by the molding device according to the embodiment and the front bumper according to the comparative example.

The front bumper 100 according to the example was evaluated through a strength test. The front bumper 100 according to the example and the front bumper 200 according to the comparative example were subjected to static press evaluation through analysis using a test device 170 shown by an imaginary line of FIG. 7. The crush tubes 81 and 82 on both sides were completely fixed, a load was applied to a front surface of the bumper beam 80 by the test device 170, and evaluation was made for proof stress and an energy absorption amount (EA). The results are shown in FIG. 11. Proof stress is substantially the same in the example and the comparative example until a stroke of 120 mm, and proof stress is higher in the example when exceeding the stroke of 120 mm. It can be seen that an EA amount is higher in the example over the entire stroke, and it can be seen that the performance of the front bumper is equal to or higher than in the comparative example. In the example, the number of components can be reduced by three components compared to the comparative example, and weight saving of 10% is possible while ensuring the same performance as in the comparative example.

The present disclosure is not limited to the embodiment described above. For example, the entire configuration of the molding device is not limited to that shown in FIG. 1 and can be appropriately changed without departing from the concept of the invention.

An aspect of a combination of a plurality of components is not limited. For example, the molding device may mold two components including a first component and a second component from one metal material. In addition, the molding device may mold four or more components from one metal material.

Although an example in which the front bumper is manufactured using a component molded by the molding device 1 has been described, a component of a rear bumper may be molded.

Figure 12:
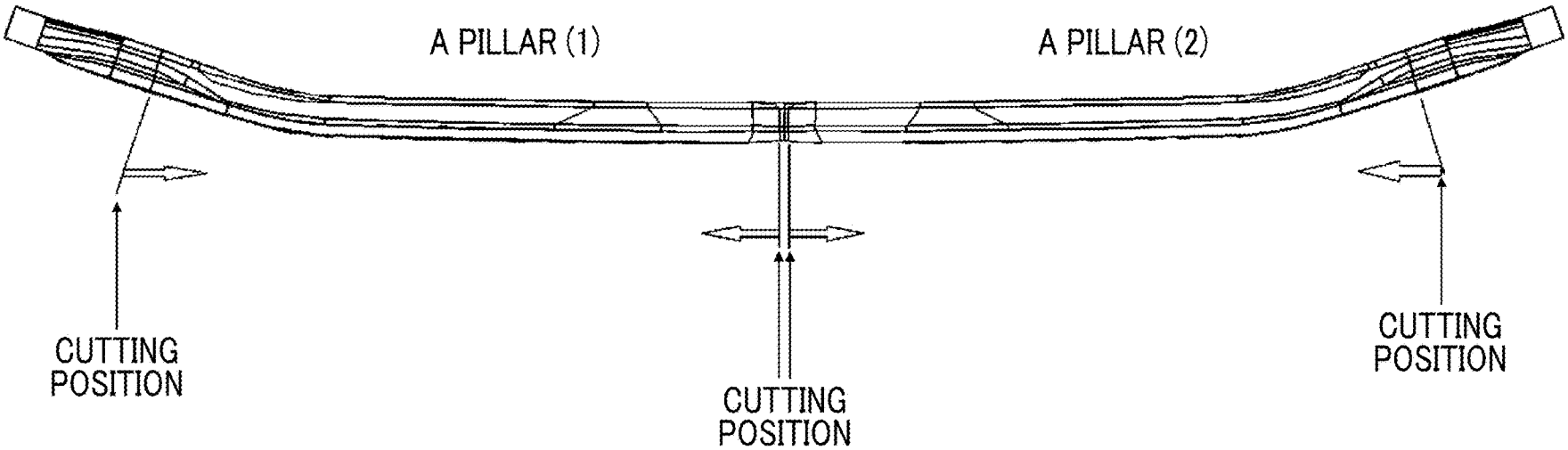
FIG. 12 is a view showing an example in which left and right A pillars are molded simultaneously.
Figure 13:
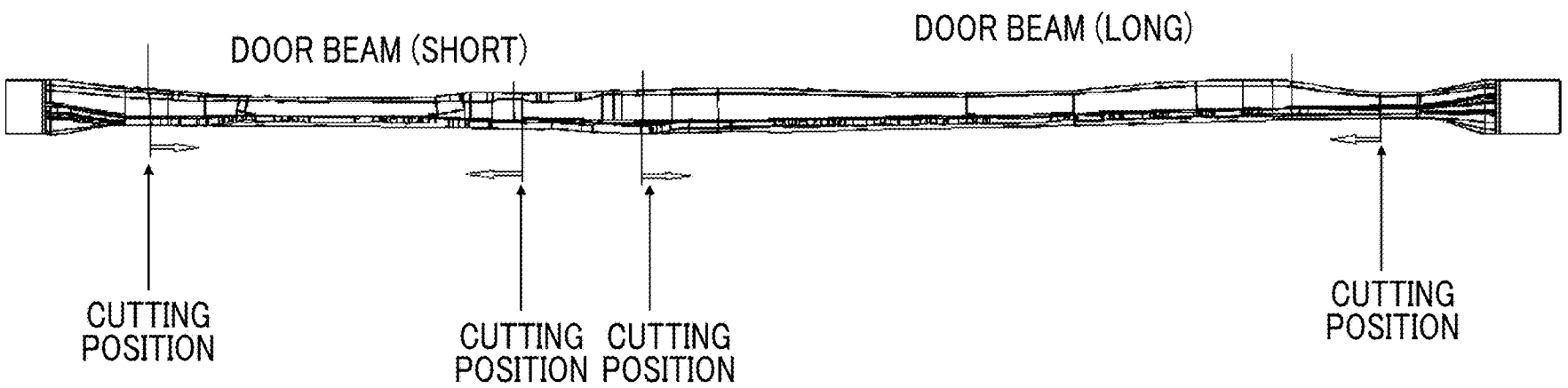
FIG. 13 is a view showing an example in which a long door impact beam and a short door impact beam are molded simultaneously.

In addition, a component molded by the molding device 1 is not limited to a configuring component of the front bumper, the rear bumper, or the like, and other components may be molded. For example, as shown in FIG. 12, left and right A pillars may be molded simultaneously. As shown in FIG. 13, a long door impact beam and a short door impact beam may be molded simultaneously. The longer door impact beam is attached to a passenger seat. The shorter door impact beam is attached to a rear seat door.

The molding device may be a molding device that heats a metal material and that performs quenching, or a molding device using a hot stamping method may be adopted.

In addition, the molding device may be a molding device that performs expansion molding by supplying a fluid to a metal material, or a molding device using a hydroforming method may be adopted.

It should be understood that the invention is not limited to the above-described embodiment, but may be modified into various forms on the basis of the spirit of the invention. Additionally, the modifications are included in the scope of the invention.

What is claimed is:

1. A molding device for heating a metal pipe material, performing quenching, and molding a molding product that includes a plurality of components having shapes different from each other in one time of molding with respect to one metal pipe material, the molding device comprising:

a molding die including a lower die and an upper die that face each other in an up-down direction, and a cooling unit configured to cool the molding die, wherein each of the lower die and the upper die includes a groove portion, the groove portion includes a plurality of component molding portions configured to mold the plurality of components, respectively, and a gradual change molding portion provided between the plurality of component molding portions, the gradual change molding portion is configured to mold a gradual change portion that is formed between the plurality of components and has a shape that gradually changes, the plurality of components are molded in a state of being connected to each other via the gradual change portion, and spaces are present inside the plurality of components and the gradual change portion, wherein the cooling unit is configured to keep a temperature of a forming surface for forming one component of the plurality of components at a temperature at which quenching can be performed and keep a temperature of a forming surface for forming another component of the plurality of components at a temperature at which quenching cannot be performed such that differential strength between the one component and the other component is provided.

2. A molding device for performing expansion molding by supplying a fluid to a metal pipe material and molding a molding product that includes a plurality of components having shapes different from each other in one time of molding with respect to one metal pipe material, the molding device comprising:

a molding die including a lower die and an upper die that face each other in an up-down direction, and a cooling unit configured to cool the molding die, wherein each of the lower die and the upper die includes a groove portion, the groove portion includes a plurality of component molding portions configured to mold the plurality of components, respectively, and a gradual change molding portion provided between the plurality of component molding portions, the gradual change molding portion is configured to mold a gradual change portion that is formed between the plurality of components and has a shape that gradually changes, the plurality of components are molded in a state of being connected to each other via the gradual change portion, and spaces are present inside the plurality of components and the gradual change portion, wherein the cooling unit is configured to keep a temperature of a forming surface for forming one component of the plurality of components at a temperature at which quenching can be performed and keep a temperature of a forming surface for forming another component of the plurality of components at a temperature at which quenching cannot be performed such that differential strength between the one component and the other component is provided.

3. The molding device according to claim 1, wherein the plurality of components each having a closed section are molded.

4. The molding device according to claim 1, wherein the plurality of components including a long first component, and a second component and a third component, which are disposed on both sides of the first component in a longitudinal direction, are molded.

5. The molding device according to claim 1, further comprising:

a heating unit including a pair of electrodes and configured to heat the metal pipe material; and wherein the cooling unit includes including a flow path inside the molding die and configured to cool the molding die.

6. The molding device according to claim 5, wherein the heating unit is configured to heat the metal pipe material by energizing the metal pipe material.

7. The molding device according to claim 6, wherein the heating unit is configured to heat the metal pipe material in a state where the metal pipe material is separated apart from the lower die and the upper die between the lower die and the upper die.

8. The molding device according to claim 5, wherein the cooling unit further includes a water circulation mechanism that supplies configured to supply cooling water to the flow path and circulate the cooling water.

9. The molding device according to claim 8, wherein the water circulation mechanism of the cooling unit is configured to flow the cooling water to a component in which quenching is performed, and not to flow the cooling water to a component in which quenching is not performed.

10. The molding device according to claim 8, wherein the cooling unit further includes a heater configured to increase a temperature of the molding die and secure a cooling speed at which quenching does not occur for a component in which quenching is not performed.

* * * * *